US005249376A

United States Patent [19]

Capria

[11] Patent Number: 5,249,376

[45] Date of Patent: Oct. 5, 1993

[54] SHOE HEEL WITH ROLLERS

[76] Inventor: Michael Capria, 700 W. Waters Ave., Tampa, Fla. 33604

[21] Appl. No.: 977,001

[22] Filed: Nov. 16, 1992

[51] Int. Cl.[5] ..... A43B 23/00

[52] U.S. Cl. ..... 36/115; 36/136; 280/11.19

[58] Field of Search ..... 36/115, 1, 116, 132, 36/136, 142, 143, 144; 280/11.19, 11.22, 11.23

[56] References Cited

U.S. PATENT DOCUMENTS

| | | | |
|---|---|---|---|
| 180,646 | 8/1876 | Saladee | 280/11.19 |
| 243,323 | 6/1881 | Sutton | 280/11.19 |
| 863,675 | 8/1907 | Towle | 280/11.19 |
| 1,068,575 | 7/1913 | Dembrey et al. | 36/132 |
| 2,165,581 | 7/1939 | Schroeder | 280/11.23 |
| 2,719,724 | 10/1955 | Lundgren | 280/11.23 |
| 3,478,447 | 11/1969 | Gillead . | |
| 3,900,203 | 8/1975 | Kukulowiez . | |
| 3,983,643 | 10/1976 | Schreyer et al. | 36/115 |
| 4,217,907 | 8/1980 | Meiller | 36/142 |
| 4,296,557 | 10/1981 | Pajevic . | |
| 4,303,253 | 12/1981 | Rottenkolber . | |
| 4,342,158 | 8/1982 | McMahon . | |
| 4,382,605 | 5/1983 | Hegna | 280/11.22 |
| 4,523,767 | 6/1985 | Le Page . | |
| 4,566,206 | 1/1986 | Weber . | |
| 4,691,453 | 9/1987 | Tifre | 36/115 X |
| 4,844,492 | 7/1989 | Ludwig . | |
| 4,928,982 | 5/1990 | Logan | 36/115 X |

FOREIGN PATENT DOCUMENTS

| | | | |
|---|---|---|---|
| 0723266 | 6/1942 | Fed. Rep. of Germany | 280/11.19 |
| 0330508 | 8/1903 | France | 280/843 |
| 0003558 | 9/1876 | United Kingdom | 280/11.22 |

*Primary Examiner*—Steven N. Meyers
*Assistant Examiner*—Ted Kavanaugh

[57] ABSTRACT

A shoe heel having rollers (20) arranged on multiple axles (18) each aligned with its longitudinal axis pointed toward the center of the shoe (16) sole. The rollers are mounted in a durable housing (14) open along its bottom with the rollers projecting out from the housing. The axles are secured along the bottom of a higher rear plate (10) and a shorter front plate (12) to maintain even contact of the rollers against a walking surface.

2 Claims, 2 Drawing Sheets

SHOE HEEL WITH ROLLERS

FIELD OF THE INVENTION

This invention relates to orthopedic footwear in general and more specifically to rollers in a shoe heel.

BACKGROUND OF THE INVENTION

Lower extremity sprain injuries and related microtrauma often result from poorly managed torsion strain in the affected ankle or knee joints. Overweight individuals often suffer knee injuries from repeated torsion strain when walking as they turn to change directions. This occurs when they pivot their feet while wearing shoes that hold fast to the average firm walking surface, and when weakness in the posterior lower extremity impedes lifting their heels while pivoting. Repeated episodes of pivoting torsion stress coupled with the heavy weight injuries supportive ligaments. Previous treatment methods for these injuries utilized elastic devices that wrapped around the involved joint. Such devices splinted the injured joint but did not reduce the offending torsion inside the joint.

A review of prior art discloses a history of interest in various roller devices to assist in propulsion, not for therapeutic goals, but for recreational purposes, including two wheeled U.S. Pat. No. 4,844,492; three wheeled U.S. Pat. No. 4,523,767; and four wheeled U.S. Pat. No. 3,900,203. These known devices cannot be used to reduce torsion strain of the knee and ankle. Another recreational roller skate U.S. Pat. No. 4,303,253 allowed a person to pivot on the ball of the foot, but it could not be used for walking.

Other prior art devices dealt with shoe heel function. These devices such as the cushioning springs of U.S. Pat. No. 4,296,557; conical springs in U.S. Pat. No. 4,342,158; and leaf spring in U.S. Pat. No. 4,566,206 attempted to reduce the vertical compression strain of running, but did little to reduce torsion strain in the ankle or knee for overweight people in normal walking situations. Prior art also discloses shoe heel devices to alter heel wear, such as U.S. Pat. No. 3,478,447 but did not reduce lower extremity torsion.

SUMMARY OF THE INVENTION

The object of this invention addresses the problem of repeated torsion stress injury of the ankle and knee in the course of walking on a flat firm surface. A roller device facilities bringing the heel around the ball of the foot pivot point with minimum torsion resistance inside the joint of the lower extremity. This shoe heel invention improves pivoting motion when changing directions in the course of normal walking. Contained in a durable housing to form the heel of a shoe are rollers on multiple axles aligned toward the center of the shoe sole near the ball of the foot. The rollers are held inside the housing in a way to maintain even contact with the floor surface when the shoe sole contacts the same surface. On a smooth flat walking surface any twisting motion imparted to the leg will result in lateral displacement of the heel device circumscribing a short arc about the ball of the foot. This pivoting motion prevents the build-up of torsion strain inside the knee and ankle joints.

BRIEF DESCRIPTION OF THE DRAWINGS

A preferred embodiment of the present invention is illustrated in the accompanying drawings in which.

DESCRIPTION OF THE PREFERRED EMBODIMENT

Figure 1:
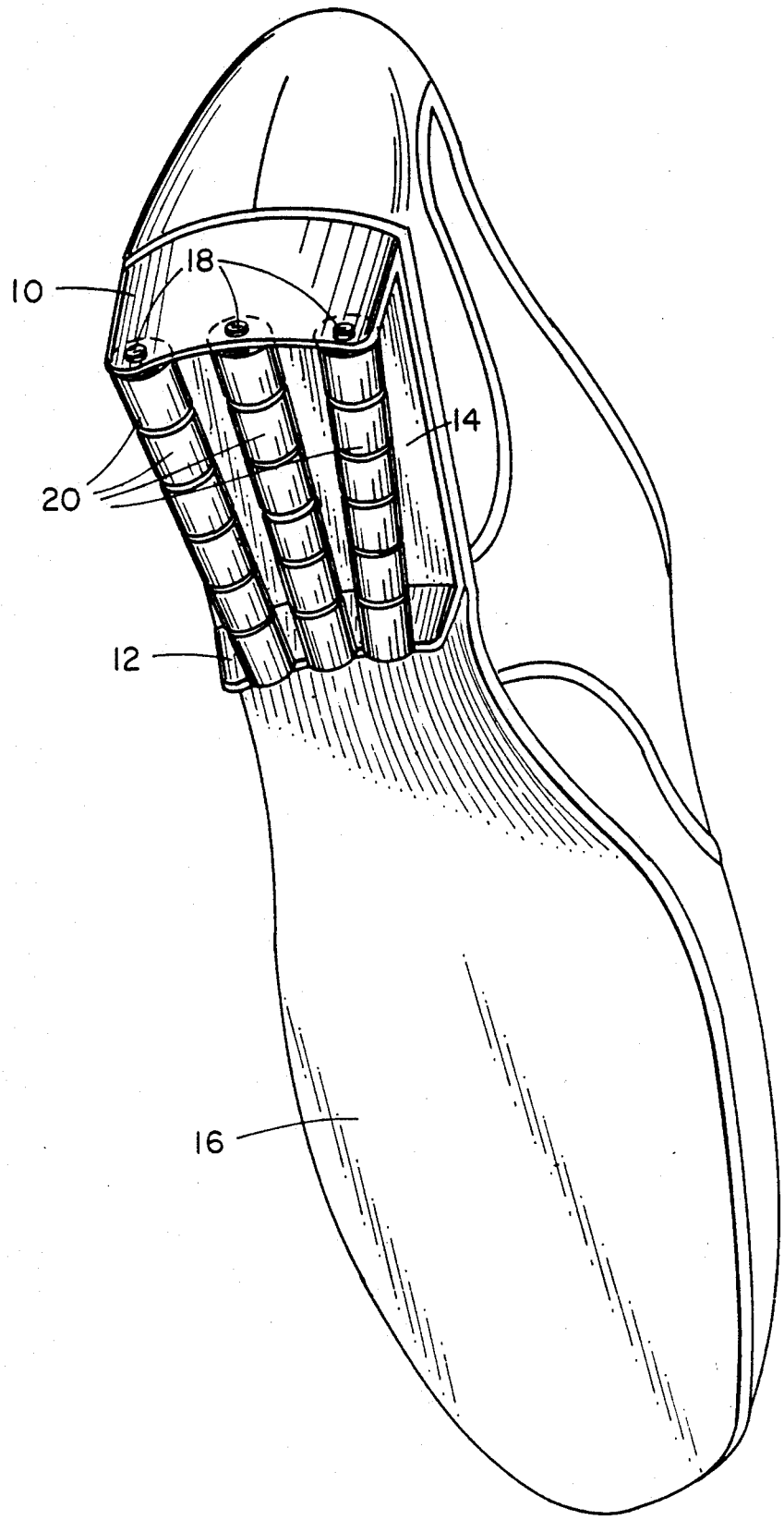
FIG. 1 is a bottom perspective view of the present shoe heel for the left foot attached to a shoe.

The drawing FIG. 1 shows an otherwise conventional shoe 16 attached to a heel device housing 14 made of durable metal material. The housing 14 has a rear plate 10 and a front plate 12 with metal axles 18 secured to the rear plate 10 and the front plate 12. Along the length of the axles are rollers 20 placed contiguous to each other.

Figure 2:
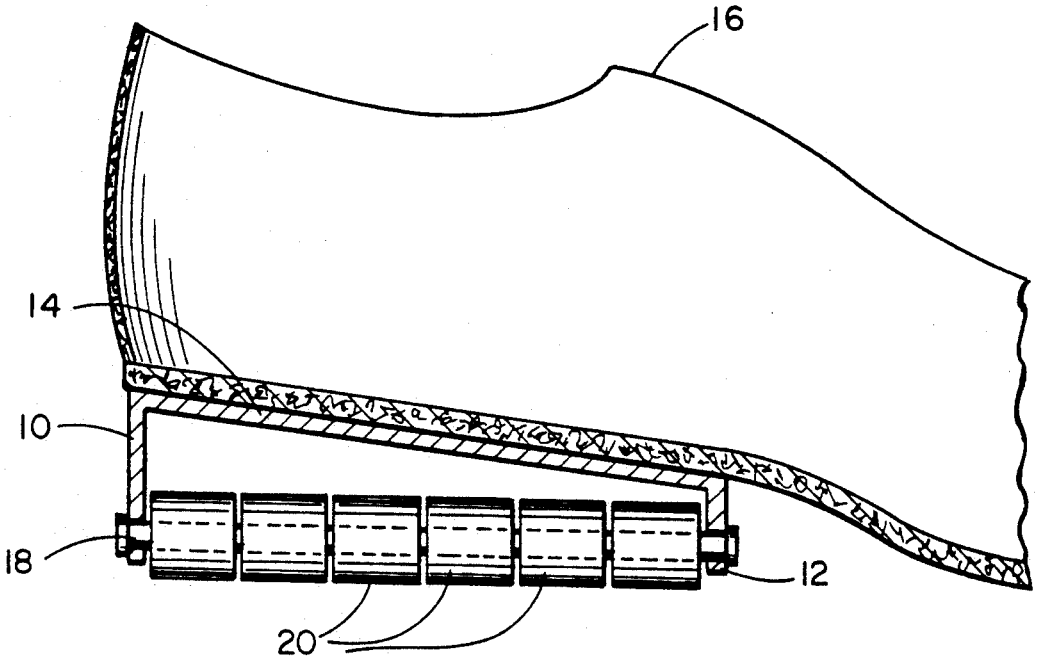
FIG. 2 is a cross-section side elevation view on the line 2—2 of FIG. 2 with part of an attached shoe.

With reference to FIG. 2 the rear plate 10 is taller than the front plate 12 to allow the axles 18 and the rollers 20 to rest on a plane even with a floor surface when the shoe 16 sole contacts the floor surface.

Figure 3:
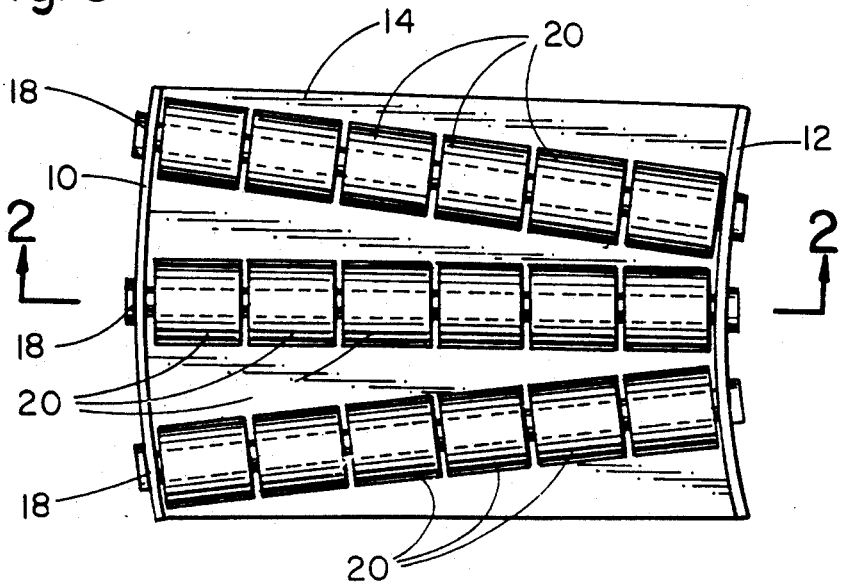
FIG. 3 is a bottom elevation view without an attached shoe.

In FIG. 3 the axles 18 are secured in positions further apart from each other on the rear plate 10 compared to closer spacing of the axles 18 on the front plate 12. The alignment of the axles 18 is determined by aligning the longitudinal axis of each axle 18 to a reference point on the middle of the sole located under the distal aspect of where the second metatarsal bone would lie. The acute forward angle formed by the relationship of the axles 18 will vary according to the shoe size.

Ramifications of the above described device are many. Lightweight durable elements will result in a lighter device for easier walking. Removable axles will allow worn out rollers to be replaced. Synthetic rollers with a hard inner core and a softer rubberized outer surface will improve traction during the heel strike of forward walking. Obvious modifications will occur to those skilled in the art to which my device pertains.

I claim:

1. A shoe heel device in combination with a shoe comprising:

a housing fastened to an undersurface rearward heel portion of the shoe;

a plurality of rollers on axles secured inside said housing wherein a longitudinal axis of said axles substantially aligns to converge on a mutual reference point located about a forward undersurface of the shoe wherein said rollers are substantially wheel shaped structures and said axles are mounted substantially adjacent to each other such that a distance between the axles approximates closer toward a forefoot region of the shoe than in a rearfoot region of the shoe.

2. The shoe heel device as claimed by claim 1 wherein the alignment and plurality of said rollers provides a means for assisting specific pivotal movement of the attached shoe in a circular arc which radius substantially measures the length of the attached shoe.

* * * * *